US009796003B2

(12) United States Patent
Polston

(10) Patent No.: US 9,796,003 B2
(45) Date of Patent: Oct. 24, 2017

(54) DRIPLESS EXPANDING TUBES FOR COMBINATION TRUCK

(71) Applicant: U.S. SUBMERGENT TECHNOLOGIES, LLC, Sarasota, FL (US)

(72) Inventor: Henry B. Polston, Livingston, TX (US)

(73) Assignee: U.S SUBMERGENT TECHNOLOGIES, LLC, Sarasota, FL (US)

( * ) Notice: Subject to any disclaimer, the term of this patent is extended or adjusted under 35 U.S.C. 154(b) by 24 days.

(21) Appl. No.: 14/686,433

(22) Filed: Apr. 14, 2015

(65) Prior Publication Data

US 2015/0360259 A1 Dec. 17, 2015

Related U.S. Application Data

(60) Provisional application No. 61/979,185, filed on Apr. 14, 2014.

(51) Int. Cl.

| | |
|---|---|
| ***B08B 9/053*** | (2006.01) |
| ***B08B 9/027*** | (2006.01) |
| ***B08B 9/032*** | (2006.01) |
| ***B08B 9/049*** | (2006.01) |
| ***E03F 9/00*** | (2006.01) |
| *B08B 9/08* | (2006.01) |

(52) U.S. Cl.

CPC ..... *B08B 9/0535* (2013.01); *B08B 9/027* (2013.01); *B08B 9/0322* (2013.01); *B08B 9/0495* (2013.01); *E03F 9/00* (2013.01); *B08B 9/08* (2013.01)

(58) Field of Classification Search

CPC ..... E03F 9/00; B08B 9/00; B08B 9/04; B08B 9/043; B08B 9/0433; B08B 9/0436; B08B 9/045; B08B 9/049; B08B 9/0495; B08B 9/053; B08B 9/0535; B08B 9/08; C02F 2201/008

See application file for complete search history.

(56) References Cited

U.S. PATENT DOCUMENTS

| | | | | |
|---|---|---|---|---|
| 4,201,597 A * | 5/1980 | Armstrong | E03F 9/00 | 134/113 |
| 5,018,545 A * | 5/1991 | Wells | B08B 9/0495 | 134/113 |
| 7,712,481 B1 * | 5/2010 | Mayer | E03F 9/00 | 137/351 |
| 2006/0179603 A1 * | 8/2006 | Polston | B08B 9/043 | 15/340.1 |

* cited by examiner

*Primary Examiner* — David Cormier
(74) *Attorney, Agent, or Firm* — McDonald Hopkins LLC

(57) ABSTRACT

The present invention relates generally to cleaning waste collection systems such as but not limited to sewers, sumps, wet wells, collection tanks, digesters, clarifiers, classifiers, etc. and in particular to cleaning and removal of solid and liquid materials therefrom. In another embodiment, the present invention relates to an improved slurry hose and/or pipe for use in connection with cleaning waste collection systems such as but not limited to sewers, sumps, wet wells, collection tanks, digesters, clarifiers, classifiers, etc. and in particular to cleaning and removal of solid and liquid materials therefrom.

22 Claims, 8 Drawing Sheets

DRIPLESS EXPANDING TUBES FOR COMBINATION TRUCK

CROSS REFERENCE TO RELATED APPLICATION

This application claims the benefit of U.S. Provisional Patent Application Ser. No. 61/979,185 filed Apr. 14, 2014, and entitled "DEVICE FOR HANGING ITEMS ON A VERTICAL SURFACE AND METHOD FOR MAKING AND USING SAME," the entirety of which is incorporated herein by reference.

FIELD OF THE INVENTION

The present invention relates to an improved slurry hose and/or pipe for use in connection with cleaning waste collection systems such as but not limited to sewers, sumps, wet wells, collection tanks, digesters, clarifiers, classifiers, etc. and in particular to cleaning and removal of solid and liquid materials therefrom.

BACKGROUND OF THE INVENTION

Waste collection systems such as sewers, sumps, wet wells, digesters, clarifiers, classifiers, collection tanks, etc. must be cleaned periodically in order to maintain proper fluid flow and capacity. Cleaning removes sand and other deleterious materials that have infiltrated into, for example, a sewer as well as solid materials that have settled out from the normally slow moving waste slurry that varies in volume and flow rate depending on the collective amount of effluents emptied into the waste collection system over time. In order to properly clean large capacity waste collection systems such as collection tanks or the vast lengths of sewer lines in a typical city, an efficient and cost effective method of cleaning must be employed that can handle the large volume of material that must be removed from a typical waste collection system.

Typically, commercial waste cleaning operations utilize a water jet router made up of a high pressure water pump feeding pressurized wash water through a hose having a cleaning head on its end. This cleaning head has water nozzles on its back face which creates a jet action resulting from the high pressure water flowing out the nozzles. The high pressure water jet action both washes the downstream waste collection system such as sewer pipe and propels the cleaning head upstream for continuous washing action of the entire length of the waste collection system such as sewer pipe being cleaned. The position of the cleaning head and its rate of forward travel is regulated by control of the hose reel integrally mounted on the washing truck.

Commercial waste cleaning operations then utilize one or the other of the following two known systems and methods for moving the resulting water slurry produced from the washing action into a collection box, where the solid material is removed and disposed of in a dump or landfill.

First, a second hose may be lowered into a manhole downstream of the cleaning head and is in communication with the resulting water slurry produced from the washing action. This hose is connected to a vacuum system which lifts the water slurry and all contained debris up from the bottom of the manhole into a vacuum holding tank mounted on the rear of the wash truck. Thus, the high pressure wash water brings the solid materials suspended in water to the manhole and the vacuum action picks up the waste material and deposits it into the truck-mounted holding container.

When the container becomes full, the materials contained in the container are removed and disposed of, typically in a dump or landfill.

Second, the operation may include a semi-submersible pump to move the water slurry produced by the washing action into the collection box. The submersible pump pushes the slurry up in a column through a slurry hose which is connected to and deposit the slurry into a pressurized collection container located on the surface. Again, when the container becomes full, the materials contained in the container are removed and disposed of, typically in a dump or landfill.

Choosing between the use of a submersible pump to push the waste water slurry into the collection container or use of a vacuum to suck the slurry into the container turns largely on the conditions within the waste water system. If, for example, there is a large volume of liquid relative to solids in the slurry, vacuuming becomes very inefficient and possibly infeasible. A submersible pump, by contrast, requires a large volume of liquid to effectively push the slurry upward into the collection box. If very little liquid is present in the waste water system, a pump will be inefficient or may not work at all, and a vacuum is required.

Existing technologies typically include a truck or other apparatus with a high pressure washer, and either a pump or vacuum for moving the waste water slurry into the collection box. Because field conditions dictate which type of technology is used, though, it is generally necessary to go to the particular waste water system to be cleaned and examine the conditions before choosing an apparatus to perform the work and delivering the apparatus to the jobsite.

SUMMARY OF THE INVENTION

In contrast to the prior waste cleaning apparatus and methods, the apparatus of the present invention is designed to eliminate the need to examine field conditions prior to dispatching a cleaning apparatus to the jobsite. The apparatus of the present invention has improved the overall cost and efficiency of cleaning waste water systems by using a new, novel and non-obvious combination of apparatus and techniques known in the art.

The apparatus of the present invention is directed to continuous cleaning of waste collection systems such as city sewers, sumps, wet wells, digesters, clarifiers and collection tanks by high pressure water washing of the waste collection system and collection of the resulting solid materials washed therefrom. The present invention may clean any system or device that collects solids, liquids or both. The invention may comprise (1) a source of high pressure water; (2) a submersible pump capable of pumping solids and liquids; (3) a vacuum system capable of vacuuming solids and liquids; (4) a pressurized container where solid materials separate from the liquids (water) by gravity; (5) means to remove the water in the pressurized container separated from the solid materials (decanted water); and (6) means to reuse the decanted water for cleaning of the waste collection system.

The high pressure water source may be a truck-mounted pump connected to a water tank or fire hydrant for its source of water. This pumping truck additionally may comprise a high pressure water hose attached to the pump and a hydraulically actuated hose reel. Mounted at the other end of the high pressure hose may be a bullet-shaped cleaning head. The cleaning head has water jet orifices on its rear face. When high pressure washing water exits through these orifices, the cleaning head is propelled forward by jet action.

Rate and distance of cleaning head movement is operator controlled by the hose reel and the tethering restraint of the hose attached to the head. For example, the cleaning head and its attached hose is lowered into a manhole and then placed into the sewer pipe to be cleaned. Next, high pressure water is forced through the rear jets of the cleaning head propelling it into the sewer pipe.

A source of high pressure water may also be derived from a kite. A kite is a funnel made up of flexible material such as, for example, canvass which is restrained by lines to a cable that goes back to the upstream manhole of the waste collection system, such as a sewer. When the kite is placed into a pipe of the waste collection system, water backs up behind it and reduces the flow of water through the pipe to the flow of water that can pass through the diameter of an opening in the end of the kite funnel.

As head pressure builds up behind the kite, water squirts out of the funnel opening like from a high pressure fire hose. For example, at 30 feet of head pressure and a 30-inch diameter pipe reduced to a six-inch opening, there may be 400 psi water coming out of that six-inch hole at the end of the kite funnel. This water pressure is much more than can be generated by a hose/nozzle head as described above. The kite may be reeled downstream through the pipe by paying out the cable attached thereto. As the kite moves downstream through the waste collection system, the solid debris is washed toward the submergible pump or vacuum system.

Yet another source of high pressure water is the Wayne ball. A Wayne ball is a ball that is approximately the same size as the inside diameter of the pipe being cleaned. This ball has concentric helical grooves cut into its surface in which water runs through the grooves and spins the ball. As the Wayne ball spins it agitates the surrounding material in the pipe and moves this material ahead of the Wayne ball toward the submergible pump or vacuum system. The Wayne ball is restrained, like the kite above, on a cable attached pivotally to the ball and allowing the ball to spin from the water flowing through the helical grooves. Water pressures obtained with a Wayne ball are similar to those pressures obtained with a kite.

Pumping Waste Slurry:

The washing action of the high pressure water flowing through the above water pressure sources produces a slurry of waste material solids suspended in the wash water and any other liquids present in the waste collection system. If a substantial amount of liquid exists in the waste water system, a submersible pump is used to push the waste slurry created by the high pressure washing action into a pressurized collection box on the surface. The submersible pump has a greater pumping capacity in gallons per minute ("GPM") than does the water flow even with the additional wash water. Thus, little or no flow gets past this submersible pump. The submersible pump is capable of lifting almost pure solids to the surface above the waste collection system. On the surface, a pressurized waste container is used for the collection of the slurry.

The pressurized container receiving the slurry from the submersible pump works with a positive pressure to atmosphere. This allows rapid settlement to the bottom of the container of the solid materials in the slurry by means of gravity. Thus, the water contained in the slurry will float to the top of the settled solids and may be easily removed and reused and only the solids need to be transported away and disposed of at a dump.

In practice, the slurry hose is in communication with the top of the pressurized container and the solid material rapidly falls out of the incoming slurry in a cascade gradient where the highest part of the solid material pile is closest to the slurry inlet. Means for removal of water separated from the slurry ("decanted water") allows the apparatus of this invention to continuously reuse a substantial amount of the wash water for further cleaning operations. Thus, a significant advantage of the submersible pump is the conservation of water by almost total capture and subsequent reuse of both wash water and normal sewer water flow.

Filtered decanted water may be used as a water source for the high pressure water pump. In addition, excess decanted water may be emptied upstream of the washing operations, thus, improving existing cleaning operations water flow. In practice, faster and better waste collection system washing operations are achieved when the water flow and volume are increased. Thus, as mentioned above, the submersible pump does not require a limited water flow as does the vacuum system, and actually benefits from increased water flow.

A submersible pump is also capable of handling a much higher flow capacity than a vacuum system. For example, a vacuum system can handle only about 700 GPM of waste slurry. A pump, by contrast, can typically handle about 2,500 GPM of slurry. In one embodiment, the submersible pump of the instant disclosure may handle about 3,500 GPM. Thus, a submersible pump may be preferred in some situations because it can pump slurry into the collection container at a much higher rate than the vacuum can handle. In one embodiment, the vacuum system may be rated to handle about 9500 CFM (Cubic Feet per Minute).

Using a submersible pump with a positive pressure collection container allows for decanting slurry water back into the manhole as the solid material settles out in the collection box simultaneously with the pumping of waste slurry into the collection box. This simultaneous decanting is unavailable using a vacuum system. Thus, when using a submersible pump, the process needs to be stopped to unload the material from the collection box only when the box is completely filled with solid material. By contrast, vacuuming must cease when the collection box fills up with a combination of solid material and liquid. The more frequent stoppage using a vacuum system results in less efficient operation. Subsequently, use of a submersible pump allows for cleaning more length of pipe per time interval than does vacuuming.

Vacuuming Waste Slurry:

A submersible pump requires a significant amount of liquid in the system to be cleaned in order to operate effectively. When there is not enough liquid to utilize the pumping system, the present invention is capable of using a vacuum system to handle drier materials in much the same way as conventional vacuum cleaning systems. As discussed above, the vacuum system is somewhat less efficient than the pumping system. However, in dry conditions it is necessary to use a vacuum rather than a pump to move waste slurry to the surface and into the collection container. Unlike any previously utilized technology, the present invention may be easily converted between pumping and vacuuming as conditions dictate.

An object of the present invention is to efficiently wash sewer and other pipe lines by using either a submersible pump or vacuum technology to move waste slurry scrubbed from the pipe by high pressure water to the surface and into a collection container.

A further object of the present invention is to switch quickly and easily between a submersible pump and vacuum technology to move waste slurry scrubbed from a pipe by high pressure water to the surface and into a collection container.

Yet a further object of the present invention is to provide an apparatus capable of utilizing either a submersible pump or vacuum technology to move waste slurry scrubbed from a pipe by high pressure water to the surface and into a collection container, such that pipe conditions and liquid content do not need to be identified prior to dispatching the apparatus to the jobsite.

In light of the above, in one embodiment, the present invention is directed to an apparatus for cleaning waste collection systems comprising: a source of water; at least one device to pressurize the water; a pipe-shaped device designed to direct the pressurized water against solid materials contained in a waste collection system, whereby the solid material is suspended in a water slurry; at least one device designed to control the movement of the pipe-shaped device so as to inject pressurize water through the waste collection system; at least one pumping device designed to pump a slurry comprised of liquids and solids from the waste collection system, wherein the at least one pumping device is located downstream of the at least one device designed to pressurize the water; at least one device designed to vacuum a slurry comprised of liquids and solids from the waste collection system, wherein the at least one vacuuming device is located downstream of the at least one device designed to pressurize the water; at least one waste container; and at least one device designed to decant water from said waste container, wherein the pipe-shaped device is composed of a flexible section having a first end and a second end and a telescoping section having a first end and a second end formed from at least two sub-sections, where the first end of the flexible section is adapted to be joined to the waste container and the second end is adapted to be joined to the first end of the telescoping section, and where the second end of the telescoping section is open so as to enable the pipe-shaped device to accomplish both of ejecting pressurized water therefrom or vacuuming slurry into and through the pipe-shaped device to the waste container.

In another embodiment, the present invention is directed to an apparatus for cleaning waste collection systems comprising: at least one device adapted to pressurize water; a tubular member designed to direct the pressurized water against solid materials contained in a waste collection system, whereby the solid material is suspended in a water slurry; at least one device designed to control the movement of the tubular member so as to inject pressurize water through the waste collection system; at least one pumping device designed to pump a slurry comprised of liquids and solids from the waste collection system, wherein the at least one pumping device is located downstream of the at least one device adapted to pressurize the water; at least one device designed to vacuum a slurry comprised of liquids and solids from the waste collection system, wherein the at least one vacuuming device is located downstream of the at least one device designed to pressurize the water; at least one waste container; and at least one device designed to decant water from said waste container. The tubular member is composed of a flexible section having a first end and a second end and a telescoping section having a first end and a second end formed from at least two sub-sections, where the first end of the flexible section is adapted to be joined to the waste container and the second end is adapted to be joined to the first end of the telescoping section, and where the second end of the telescoping section is open so as to enable the tubular member to accomplish both of ejecting pressurized water therefrom or vacuuming slurry into and through the tubular member to the waste container.

The telescoping section of the tubular member may be formed from three or more sub-sections. Further, the telescoping section of the tubular member may be formed from four or more sub-sections. The sub-sections of the telescoping section of the tubular member may decrease in cross-sectional diameter as they proceed away from the waste container end of the tubular member. Alternatively, the sub-sections of the telescoping section of the tubular member may increase in cross-sectional diameter as they proceed away from the waste container end of the tubular member. Each sub-section of the telescoping section of the tubular member may be individually formed a metal or metallic alloy. The metal or metallic alloy may be selected from copper, iron, aluminum, titanium, steel, stainless steel, brass, or bronze.

The two or more sub-sections of the telescoping section of the tubular member may be joined together by a water-, or liquid-, tight, joint formed from a combination of a flange on the end of each sub-section and a O-ring. The flexible section of the tubular member may be formed from a polymer material, a plastic material, or a synthetic or natural rubber material.

DETAILED DESCRIPTION OF THE INVENTION

Figure 1:
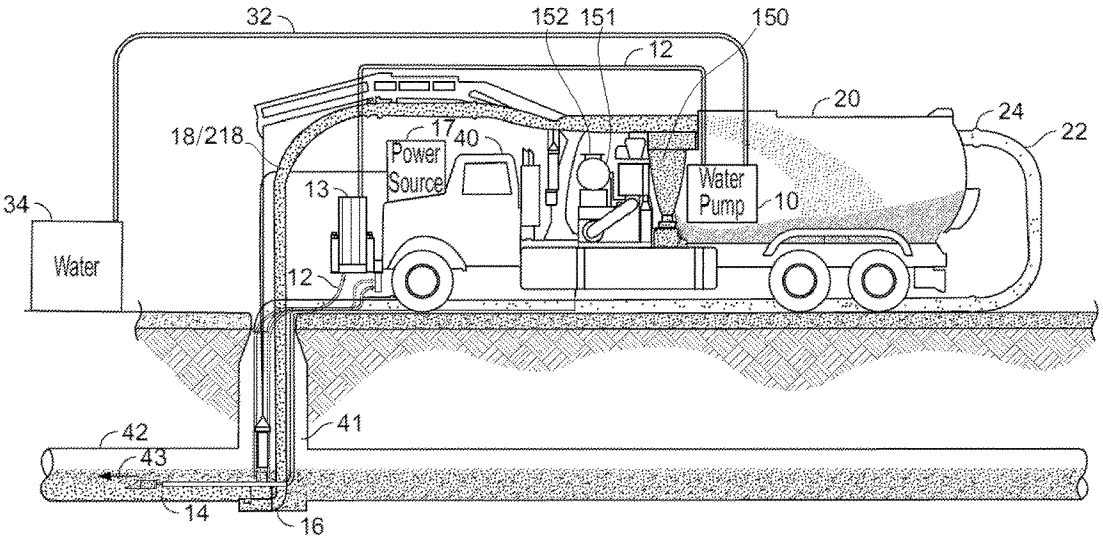
FIG. 1 is a view of an embodiment of the apparatus of the present invention wherein a submersible pump is utilized to pump the waste slurry into the waste container.
Figure 2:
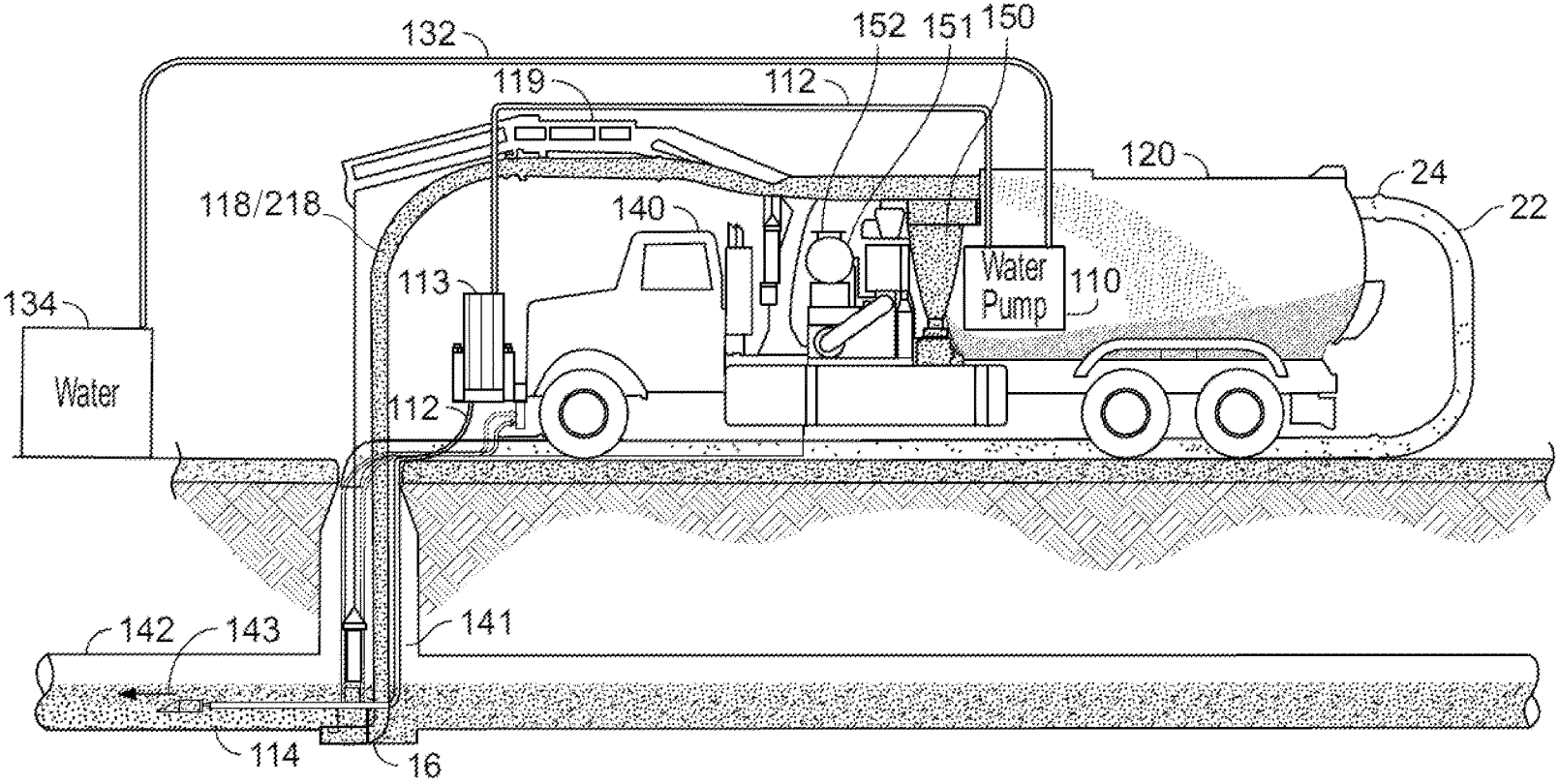
FIG. 2 is a view of an embodiment of the apparatus of the present invention wherein a vacuuming system is utilized to move the waste slurry into the waste container.
Figure 3:
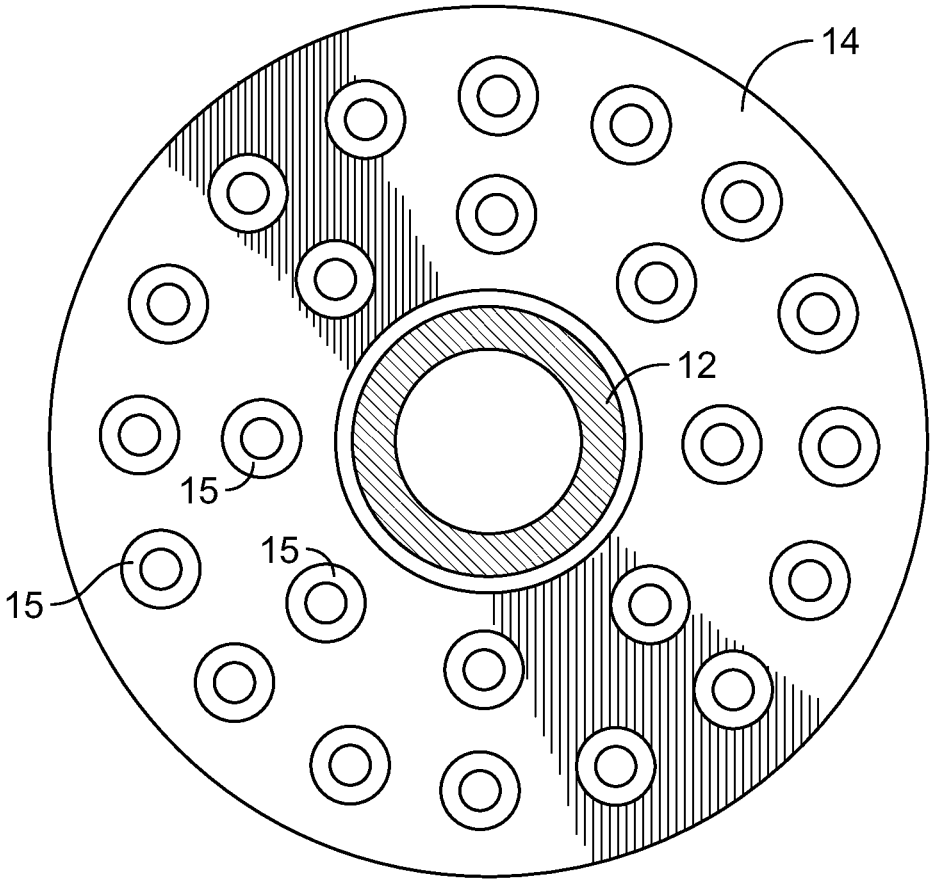
FIG. 3 is a rear view of a cleaning head.

Referring now to FIGS. 1 and 2, the system of the present invention comprises a high pressure water pump assembly 10 for generating high pressure water, a high pressure water hose 12, a hose reel 13, a cleaning head 14 for receiving high pressure water and cleaning a sewer, a submersible pump 16 for pumping a slurry of solids and liquids out of the sewer when the slurry contains a large amount of liquid, a power source 17 for the submersible pump 16, a slurry hose 18, a waste container 20 for receiving the pumped slurry, a decant water hose 22, a decant water outlet 24 for releasing the water from the container, main supply water line 32, and main supply water source 34. The invention may be mounted to a truck 40 as seen in FIGS. 1 and 2, or to an immobile unit that must be towed to and from a jobsite. For consistency, the unit will be described as a truck throughout this document. It should be noted that while water is mentioned as the liquid in which the submersible pump 16 operates, the present teachings are not limited to such. The submersible pump 16 may operate in any kind of liquid.

The high pressure water pump assembly 10 and pump power source 17 are mounted on, for example, a truck 40 and may use the truck engine for power. The purpose of the pump assembly 10 is to pressurize water for use in washing sewer lines 42 by means of cleaning head 14 attached to and in communication with high pressure water hose 12. The source of water for pump assembly 10 may be derived from any water source 34, including a fire hydrant, a tank on the truck 40, or from the sewer 42 itself. Further, the high pressure water pump assembly 10 may be of any appropriate configuration and type. By way of a non-limiting example, the high pressure water pump assembly 10 may be configured as a hydraulically driven down-hole (submersible) pump. While a single water pump assembly 10 is shown and described, any number of water pump assembly 10 may be utilized without departing from the present teachings, e.g., two, three, four, etc. In some embodiments, four water pump assemblies 10 may be attached to a single truck.

The cleaning head 14 may be bullet-shaped with a front and rear face. The rear face of the cleaning head 14 may include water jet outlets 15 directed backwardly. The truck 40, high pressure water hose 12 and cleaning head 14 may be of any suitable conventional equipment. When the cleaning head 14 is lowered through a manhole 41, and into a sewer 42, high pressure water, such as 2000 psi may be applied through the hose 12 to the cleaning head 14. The high pressure water applied to the cleaning head 14 has several functions. First, the water sprays out of the outlets 15 and the exiting high pressure water washes the solid material from the walls of the sewer 42 and suspends the sewer pipe solid material in a slurry. Additionally, the high pressure water being applied to the cleaning head 14 moves the cleaning head 14 in a direction 43. After cleaning the sewer 42, the cleaning head 14 may be retrieved by retracting the high pressure water hose 12 by means of hose reel 13.

If conditions dictate that a submersible pump 16 should be used, i.e., if a relatively high volume of liquid exists in the sewer 42, a submersible pump 16 is provided with a capacity of more than the total flow of water being injected to the cleaning head 14 as well as any normal sewer flow. It is desirable to have a large water content in the sewer 42 for efficiently cleaning the sewer 42 by suspending the solid particles and material in the sewer 42 in a liquid slurry. The submersible pump 16 is capable of pumping a slurry having up to 80% solids.

For example only, if the high pressure water pump provides a flow of 60 gallons per minute, a suitable submersible pump 16 capable of removing 2000 gallons a minute of 80% solid material is desirable for allowing the present invention to clean an operating sewer having flowing fluids therein. While any suitable submersible pump 16 may be provided, pump series 53, sold by Garner Environmental Services, Inc., is satisfactory. Such pumps can be powered hydraulically and powered by diesel, electric motors, gasoline engines or any other available power source. Additionally, a jetter type sewer pump is contemplated herein. In one embodiment, two jetter sewer pumps may be utilized having a rating of 180 GMP.

The fluidized slurry from the submersible pump 16 may be transmitted through the slurry hose 18 to a waste container 20. The fluidized slurry enters the top of the container 20, where the solids and water separate and the solids settle to the bottom of the container by gravity. If desired, baffles may be provided in the container 20 to assist in the separation. The water is then decanted from the container 20 and as the container 20 fills up, the decanted water is released from the container 20 by means of the positive pressure forcing the water through a decant water hose 22. The waste container 20 may be of any appropriate configuration and type. By way of a non-limiting example, the waste container 20 may be pressurized as described in more detail below. While a single submersible pump 16 is shown any described, any number of submersible pumps 16 may be utilized, e.g., two, three, four, etc.

The waste container 20 may be either permanently affixed to the truck 40, or may be removable therefrom. If the waste container 20 is removable, when the container 20 is substantially filled up with solid particles, it may be removed and a replacement container 20 may be rolled into place and connected to hoses 18 and 22. The filled container 20 may then be removed to a dump site while the truck 40 remains on site and continues the cleaning operation. If the waste container 20 is permanently affixed to the truck 40, the truck 40 must go to the dump site each time the waste container 20 becomes substantially filled up with solid materials. Further, still multiple waste containers 20 may be utilized without departing from the present teachings. In such embodiments, the waste containers 20 may be operatively attached with one another, such as in a series. In these embodiments, if one of the waste containers 20 is filled with solid materials, the adjacent waste container 20 may then become filled with the slurry as described above. If multiple waste containers 20 are used, each of the waste containers 20 may be continuously filled such that the pump 16 need not stop running once one of the waste containers 20 fills. Any appropriate tubing may be attached between the plurality of waste containers 20.

When the submersible pump 16 is used, the more water that flows through the cleaning head 14 and sewer 42 the better the cleaning operation. In the present system, the decanted water can be used to provide additional washing by injecting it upstream of the cleaning head 14 and pump 16. This allows keeping the solid materials in the sewer in suspension so that they can more easily be removed by the pump 16. The decanted water is transmitted through decant water outlet 24 to decant waterline 22 and then to a manhole 41 into the sewer 42 upstream of the cleaning head 14 for increasing the water in the sewer flow.

This additional water, applied to the sewer 42 aids in more efficiently cleaning the sewer 42, and the pump 16 has the capacity to completely remove the water in the system. Thus, the present embodiment is in effect a closed loop and the decanted water, all water injected or decanted, is utilized in cleaning the upstream portion of the sewer. Furthermore, the water need not be disposed of by trucking After the sewer 42 is cleaned, the cleaned decanted water may be disposed of in the sewer 42. For example, present systems utilize 60 gallons of water per minute for injection from the cleaning head 14. If additional water is available for supply to the cleaning head 14, a better water injection system and cleaning system can be provided. When cleaning a fully charged sewer, i.e., sewer capacity at maximum, the decanted water may be disposed of in a downstream sewer.

Referring now to FIG. 2, the system comprises a truck-mounted high pressure water pump assembly 110 for generating high pressure water, a high pressure water hose 112, a hose reel 113, a cleaning head 114 for receiving high pressure water and cleaning a sewer, a vacuum system comprising a vacuum tube 118 held in place by a boom 119, an air pump 150 used to create the vacuum, generally located at or near a silencer 151 and a discharge point 152 where air is released to the atmosphere. The system further comprises a waste container 120 for receiving the pumped slurry, a main supply water line 132, and a main supply water source 134. The boom 119 may be used to control the position of various devices and the movement of a pressure water hose 112 to inject pressurized water through the waste collection system.

The high pressure water pump assembly 110 is mounted on, for example, a truck 140. The purpose of the pump assembly 110 is to pressurize water for use in washing sewer lines 142 by means of cleaning head 114 attached to and in communication with high pressure water hose 112. The source of water for the pump assembly 110 may be derived from any water source 134, including a fire hydrant, a tank on the truck 140, or from the sewer itself. The pump assembly 110 may be equivalent to the pump assembly 10 as described above.

The cleaning head 114 may be bullet-shaped with a front and rear face. The rear face of the cleaning head 114 has water jet outlets directed backwardly. The truck 140, high pressure water hose 112 and cleaning head 114 may be of any suitable conventional equipment. When the cleaning head 114 is lowered through a manhole 141, and into a sewer 142, high pressure water, such as 2000 psi is applied through the hose 112 to the cleaning head 114. The high pressure water applied to the cleaning head 114 has several functions. First, the water sprays out of the outlets and the exiting high pressure water washes the solid material from the walls of the sewer 142 and suspends the sewer pipe solid material in a slurry. Additionally, the high pressure water being applied to the cleaning head 114 moves the cleaning head 114 in a direction 143. After cleaning the sewer 142, the cleaning head 114 may be retrieved by retracting the high pressure water hose 112 by means of the hose reel 113.

If conditions dictate that a vacuum system be used, i.e., if a relatively small volume of liquid exists in the sewer 142, a vacuum system comprising a vacuum tube 118 held in place by a boom 119, an air pump 150, generally located at or near a silencer 151 and a discharge point 152 where air is released to the atmosphere, is provided. The air pump 150 creates a negative pressure in the system, causing slurry to be sucked up through the vacuum tube 118 and into the waste container 120. The solid material in the waste slurry then falls to the bottom of the waste container 120. The air pump 150 continues to pull the air in the container 120 through the air pump 150, and through the silencer 151 before being released to the atmosphere through the discharge point 152.

Use of a submersible pump allows for decanting of water simultaneously while performing the cleaning operation. This may not be possible with a vacuum system. However, because a submersible pump cannot be used effectively when little or no water exists in the pipe to be cleaned, the vacuum system is necessary to deal with these types of situations. In these embodiments, the submersible pump may not be capable of use when the vacuum system is in operation or it may be capable of use simultaneously with the vacuum system. Similarly, the vacuum system may not be capable of being used simultaneously with the submersible pump or it may be capable of being used simultaneously.

Figure 4:
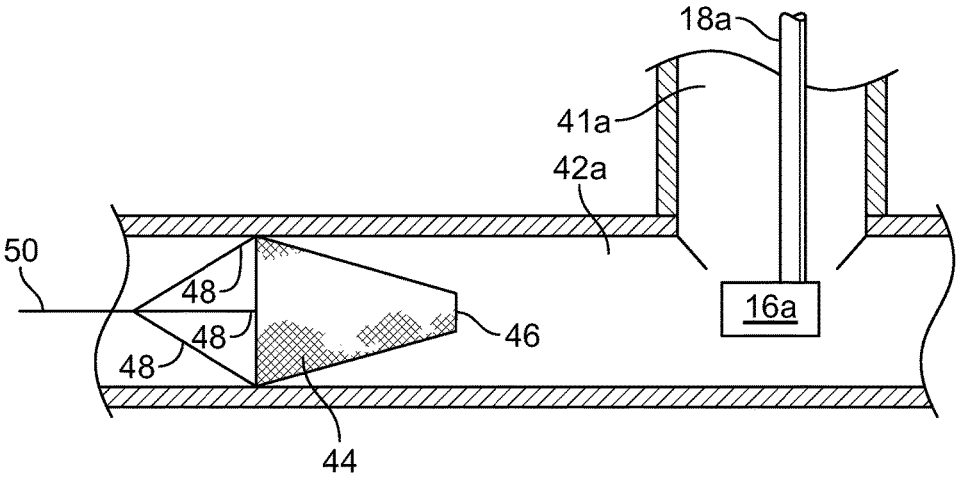
FIG. 4 is a view of a kite as used in the present invention.
Figure 5:
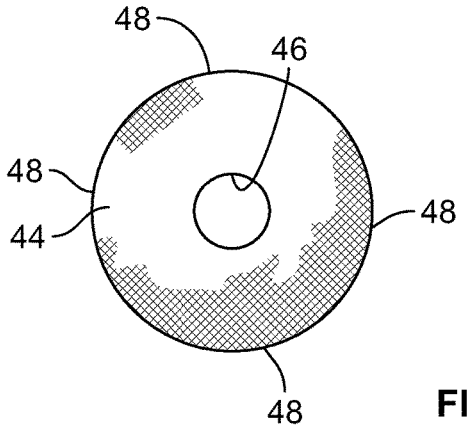
FIG. 5 is a front view of the kite of FIG. 4.

Loosening solid materials, i.e. debris, mud, etc. from the walls of the waste collection system and getting the solid materials to the submersible pump 16 requires a high pressure stream of water. A pressurized water pumping system as described above is not always available or practical for cleaning the waste collection system. Referring now to FIGS. 4 and 5, a kite 44 is illustrated schematically. The kite 44 may be placed in sewer 42*a* upstream of submersible pump 16*a*. Water flowing in sewer 42*a* is blocked by the kite 44 acting effectively as a dam. The only exit for the dammed water is through opening 46. Water builds up behind kite 44 forming a hydrostatic head pressure that creates a high pressure stream of water emitting from the opening 46 of the kite 44 apex. This high pressure stream of water effectively breaks loose solid material attached to the walls of sewer 42*a* and allows sufficient flow rate to suspend the solid materials in the water for subsequent removal by submersible pump 16*a*.

The position of kite 44 in the sewer 42*a* is controlled by cable 50 attached to the kite 44 by lines 48. Kite 44 is made of a flexible water proof material such as, for example, canvas. The flexible material is formed into the shape of a funnel and restrained by lines 48 which in turn are attached to the cable 50.

Figure 6:
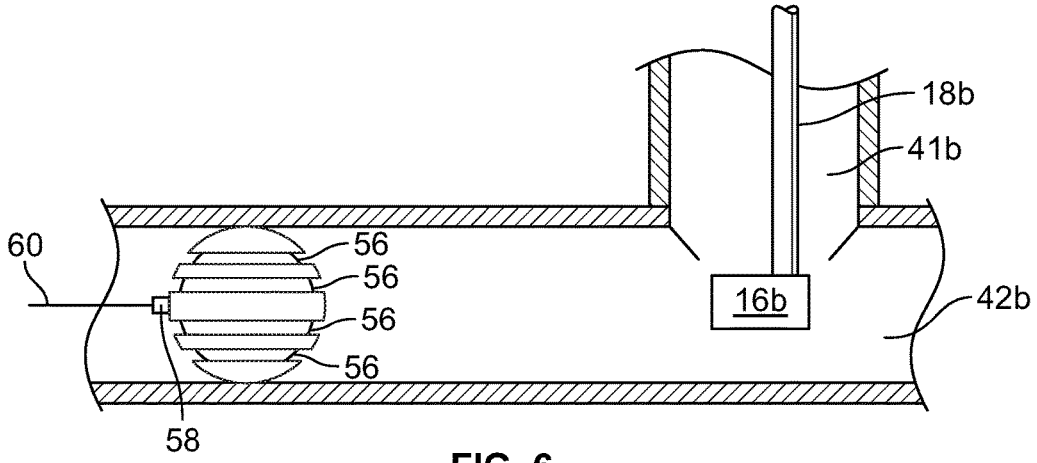
FIG. 6 is an elevational view of a Wayne ball as used in the present invention.

Referring now to FIG. 6 a Wayne ball 54 is illustrated schematically. The Wayne ball 54 is a ball having a diameter approximately the same size as the inside diameter of the pipe to be cleaned. The Wayne ball 54 has concentric helical grooves 56 on its face in which water flows at high pressure while rotating the Wayne ball 54. The position of Wayne ball 54 is controlled by cable 60 which is pivotally attached by means of pivot 58. The rotation of Wayne ball 54 and the high pressure streams of water emitting from grooves 56 agitates the solid materials built up on the walls of sewer 42*b*. In addition, the high pressure water effectively washes and cleans the material from the walls while moving the suspended solids down toward the submersible pump 16*b*.

The present invention is not limited to just cleaning sewers, any waste collection system such as but not limited to sewers, sumps, wet wells, collection tanks, digesters, clarifiers, classifiers, etc. where cleaning and removal of solid and liquid materials is required. The present invention is a new, novel and more efficient way of capturing solid and liquid waste by emulsifying the solids in suspension and capturing it by the means disclosed above. The apparatus of the present invention, therefore, is well adapted to carry out the objects and attain the ends and advantages mentioned as well as others inherent therein.

In some embodiments, the truck 40 or 140 may utilize only the submersible pump 16 or may utilize only the vacuum system, i.e., the air pump 150. In other embodiments, the truck and/or truck 140 may utilize both of the submersible pump 16 and vacuum system. In such embodiments, the submersible pump 16, i.e., the down hole pump, may be used if and when conditions dictate. If conditions are not conducive to use of the down hole pump, the vacuum system may be deployed.

Figure 12A:
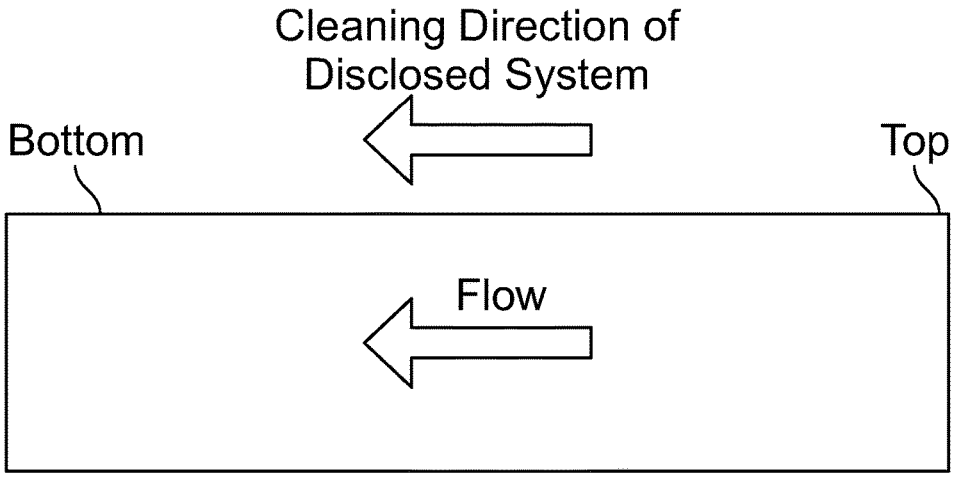
FIG. 12A is a schematic diagram of an embodiment of a system of the present disclosure.
Figure 12B:
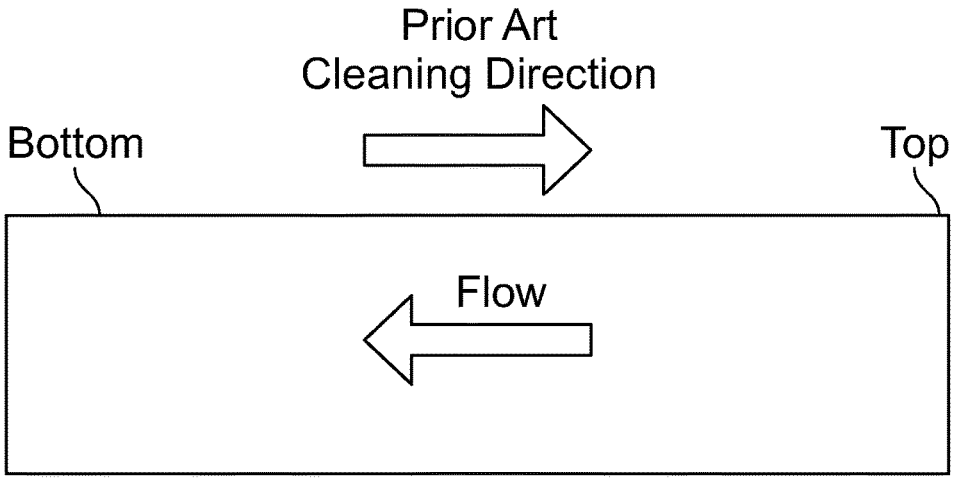
FIG. 12B is a schematic diagram of a prior art system.
Figure 13:
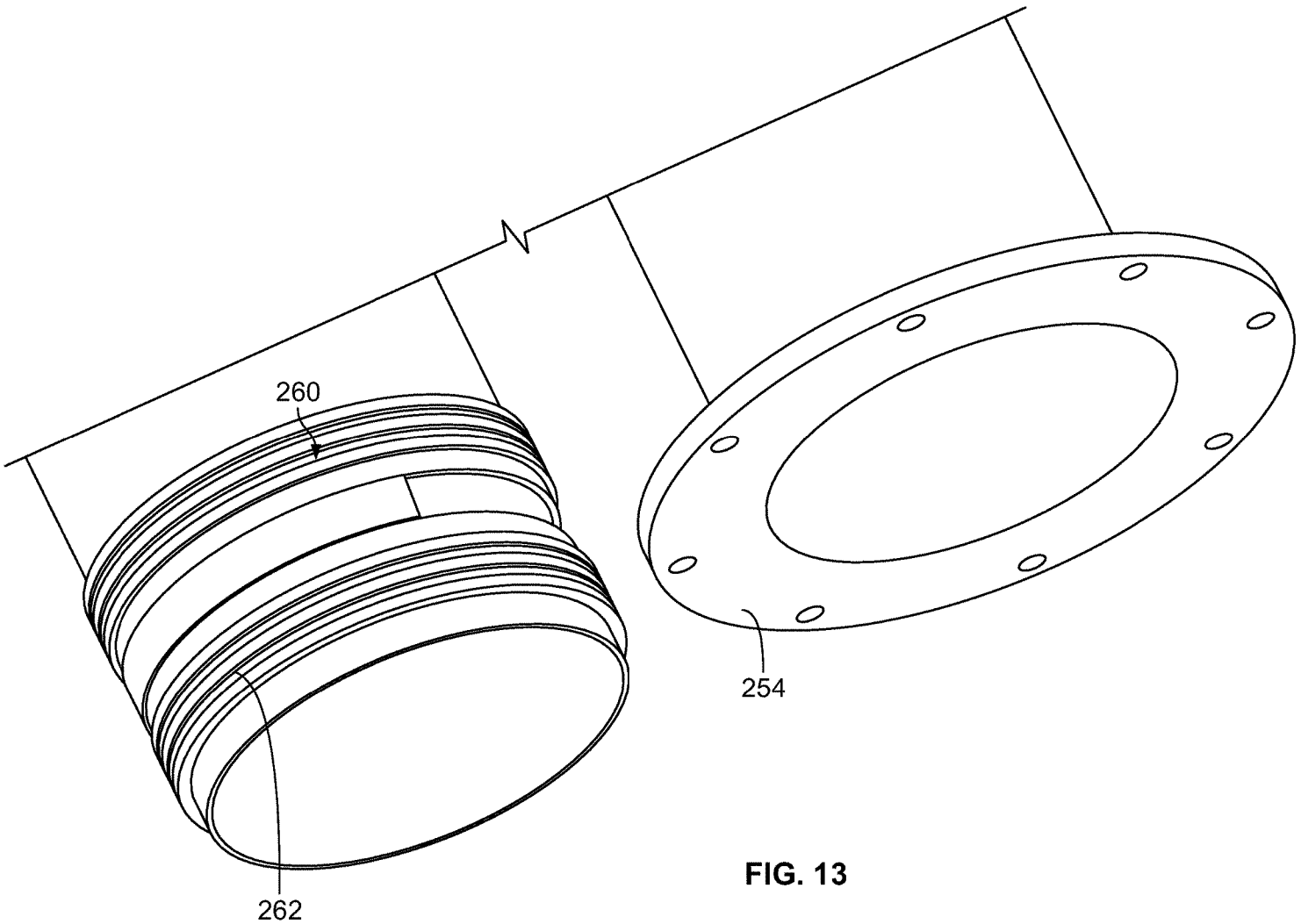
FIG. 13 is an illustration of a front portion of a telescoping section of the pipe of the present disclosure.

Generally, as is performed in the art, a sewer pipe may be cleaned initially from the lower end of the pipe as the pressurized/jet hose propels itself to the higher end of the pipe. See FIG. 12B. This is done by slowly withdrawing the jet hose, the water pressure and flow cleans the sewer pipe from the bottom portion to the top portion to wash debris from the inner walls of the sewer pipe. In this regard, the pressurized water and debris filled water directionally flows from the top to the bottom due to gravity. It is an inconvenience when the jet hose is prevented from entering though the sewer pipe to access the bottom portion. This requires current sewer cleaning systems to apply pressurized jetted water several times to remove all the debris. Specifically, these systems may move against the direction of flow of the liquid within the container. The result may be that debris may flow back to the portions of the container that were previously cleaned. However, the present vacuum/pump system allows the sewer pipe or other elongated area to be cleaned from the top to the bottom of the sewer system thus allowing the debris to be collected from wet or dry sewer pipes due to the vacuum/pump system as described. See FIG. 12A. In one embodiment, the power of the submersible pump is sufficient to pump all or substantially most of the pressurized water and debris into the waste container. Portions of remaining debris, such as sand or grit may remain in the sewer pipe. The vacuum may be introduced to remove the remaining debris as this debris has a higher ratio of debris to water. For example, the submersible pump 16 may move in the direction of the flow of the liquid within the container. As the submersible pump 16 moves with the flow (i.e., the pressure from the submersible pump 16 is great enough it drives the submersible pump 16 in a predetermined direction) it produces enough power to pick up the debris. As it is moving in the direction of the flow, it prevents the debris from re-entering the areas of the container that have been cleaned. Further, as the submersible pump 16 moves it may create a weir (barrier of sand). When the submersible pump 16 reaches the end of the container or as far as it intends to travel the vacuum system may be useful in picking up the remaining debris that forms the weir. This results in a particularly clean container.

In another embodiment the present invention relates to an improved slurry hose and/or pipe 218 for use in connection with cleaning waste collection systems of the present invention as described above. Turning to FIGS. 7 through 11, and 13, these Figures illustrate a variety of alternative embodiments for an improved slurry tube and/or pipe 218 for use in connection with the cleaning waste collection systems of the present invention. In one embodiment, as can be seen from FIG. 7, the slurry tube and/or pipe 218 of this embodiment may be formed from two adjoining main sections: (i) a flexible tube and/or pipe section 250; and (ii) a less flexible, or even rigid, telescoping section 252. The flexible tube and/or pipe section 250 of this embodiment is designed to connect the non-telescoping end of telescoping section 252 to the waste container 20/120 of the present invention. This configuration may be adapted to enable the pipe 218 to accomplish both ejecting pressurized water therefrom or vacuuming slurry into and through the tubular member to the waste container. This capability may subject the pipe 218 to various constraints to enable proper functionality.

It should be noted that the dimensions of section 250 are not limited to any one set of dimensions. Rather, section 250 of pipe 218 of this embodiment can have any desired inner pipe diameter and/or any desired length. In one non-limiting example the inner pipe diameter of the flexible section 250 of pipe 218 is between about 6 inches to about 16 inches, or between about 8 inches to about 14 inches, or even between about 10 inches and about 12 inches. Here, as well as elsewhere in the specification and claims, individual numerical values can be combined to form additional and/or non-disclosed ranges. Regarding the length of flexible section 250, the length of section 250 is not critical so long as section 250 is of sufficient length to permit both the insertion of section 252 of pipe 218 into any desired sewer, sump, wet well, collection tank, digester, clarifier, classifier, etc., as well as permit the opposite end of flexible section 250 to remain connected to the waste container 20/120 of the present teachings. In one set of non-limiting embodiment, section 250 is between about 10 to about 50 feet in length, or from about 15 to about 45 feet in length, or from about 20 to about 40 feet in length, or even from about 25 to about 35 feet in length. Here, as well as elsewhere in the specification and claims, individual numerical values can be combined to form additional and/or non-disclosed ranges. Regarding the thickness of the material utilized to form flexible section 250, the thickness of the material for flexible section 250 is not critical so long as section 250 maintains a degree of flexibility that permits it to be attached to waste container 20/120 while maintaining a suitable connection to the back end of telescoping section 252. In one non-limiting embodiment, the material utilized to form flexible section 250 can be from about 0.25 inches to about 1 inch in thickness, or from about 0.3 inches to about 0.8 inches in thickness, or from about 0.4 inches to about 0.7 inches in thickness, or even about 0.5 inches in thickness. Here, as well as elsewhere in the specification and claims, individual numerical values can be combined to form additional and/or non-disclosed ranges.

In one embodiment, section 250 can be formed from any suitable flexible material such as a polymer material, a plastic material, canvas, or a synthetic or natural rubber material. In one embodiment, the material utilized to form flexible section 250 is synthetic rubber. As would be appreciated by those of skill in the art, the end of flexible section 250 that connects to telescoping section 252 can, if so desired, be reinforced with one or more metal washers. The connection between flexible section 250 and telescoping section 252 can be accomplished in any of a variety of manners. One non-limiting example of a possible connection method includes, but is not limited to, flange joint 254. See also FIG. 13. In the case of flange joint 254 each of flexible section 250 and telescoping section 252 have at one end a flange with a plurality of attachment holes 256 therein. Although FIG. 8 details a flange joint having eight attachment holes 256, the present invention is not limited to only this number. Rather, any suitable number of attachments can be utilized to join section 250 with section 252. As such, the number of attachment holes 250 can fluctuate accordingly. In some embodiments flexible section 250 will have a metal washer encapsulated at the end of section 250 so that section 250 can be joined with telescoping section 252. As for the attachment devices that are utilized to join section 250 with section 252 via flange joint 254, such devices can be selected from a bolt-nut combination, rivets, etc.

Figure 7:
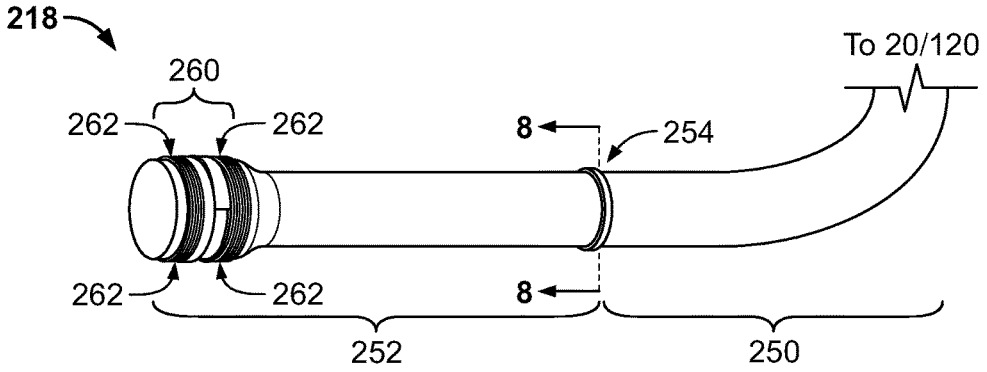
FIG. 7 is a side view of another embodiment of a pipe that can be utilized in conjunction with the apparatus of the present invention.
Figure 8:
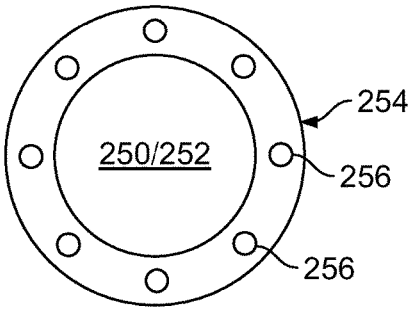
FIG. 8 is a cross-sectional view along the 8-8 line of FIG. 7 of a joint between a flexible section and a telescoping section of the pipe of FIG. 7.

Turning to the front portion 260 of telescoping section 252, as can be seen from FIG. 7, front portion 260 of section 252 has a slightly larger inner pipe diameter than the last telescoping sub-section of telescoping section 252. In one non-limiting example the inner pipe diameter of the narrowest sub-section of telescoping section 252 of pipe 218 is between about 6 inches to about 16 inches, or between about 8 inches to about 14 inches, or even between about 10 inches and about 12 inches. Here, as well as elsewhere in the specification and claims, individual numerical values can be combined to form additional and/or non-disclosed ranges. Regarding the extended length of telescoping section 252, the extended length of section 252 is not critical so long as extended section 252 is of sufficient length to permit pipe 218 to reach the desired point in a sewer, sump, wet well, collection tank, digester, clarifier, classifier, etc. In one set of non-limiting embodiment, the extended length of section 252 is between about 10 to about 100 feet in length, or from about 15 to about 90 feet in length, or from about 20 to about 80 feet in length, or even from about 25 to about 70 feet in length. Here, as well as elsewhere in the specification and claims, individual numerical values can be combined to form additional and/or non-disclosed ranges. Regarding each individual sub-section of telescoping section 252, such sub-sections can be equal in length, or even slightly longer in length as they progress back towards flexible section 250. Given the fact that the number of telescoping sub-sections can vary (as is discussed in detail below), the length for each telescoping subsection will also vary depending upon the number of telescoping sub-sections that make up the overall length of section 252. Accordingly, the present invention is not limited to telescoping sub-sections having one particular length.

Given the above, front portion 260 is, in one non-limiting embodiment, may be about 2 to about 4 inches larger in inner pipe diameter than the last sub-section of telescoping section 252. Additionally, front portion 260 has a plurality of ridges 262 (See FIG. 13) formed on the outer surface of front portion 260. In one embodiment, telescoping section 252 is formed from pipe sub-sections that decrease in inner pipe diameter from the largest inner pipe diameter sub-section that contains front portion 260 to the smallest inner pipe diameter sub-section that mates to flexible section 250. In another embodiment, telescoping section 252 is formed from pipe sub-sections that increase in inner pipe diameter from the smallest inner pipe diameter sub-section that contains front portion 260 to the largest inner pipe diameter sub-section that mates to flexible section 250. In one non-limiting example the inner pipe diameters of the all of the sub-sections of telescoping section 252 of pipe 218 are between about 6 inches to about 16 inches, or between about 8 inches to about 14 inches, or even between about 10 inches and about 12 inches. Here, as well as elsewhere in the specification and claims, individual numerical values can be combined to form additional and/or non-disclosed ranges. The difference in inner pipe diameter between sub-sections of telescoping section 252 is not limited to any one increment so long as the overall difference between the various sub-sections of telescoping section 252 permits the nesting of telescoping section 252 when not in use.

Figure 9:
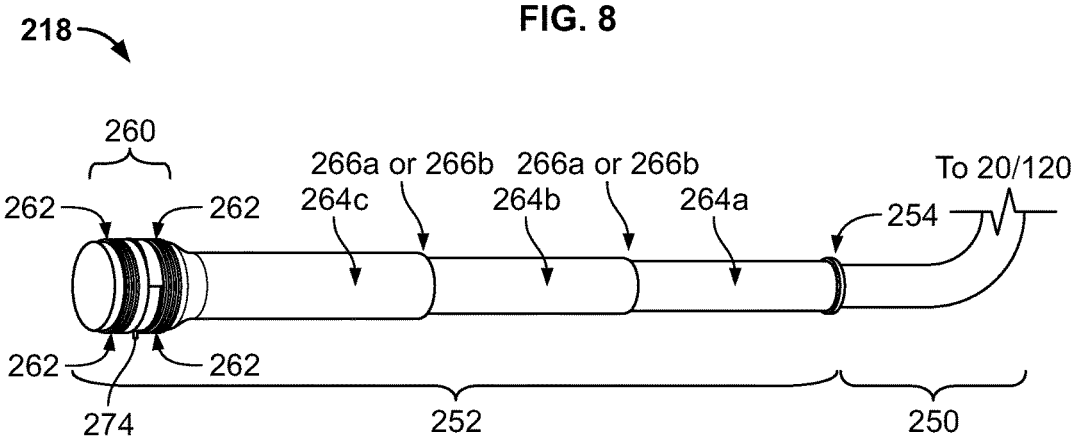
FIG. 9 is a close-up side view of the pipe of FIG. 7 with the telescoping section thereof in the extended position.

In one embodiment, telescoping section 252 may be formed from two or more, three or more, four or more, five or more, six or more, or even seven or more telescoping sub-sections that nest into one another when pipe 218 is not in use. FIG. 9 illustrates a non-limiting example of a telescoping section 252 having three telescoping sub-sections 264*a*, 264*b* and 264*c*, with the last sub-section 264*c* having front portion 260 formed at the open end thereof. Sub-section 264*a* is joined to sub-section 264*b* via a joint 266*a* or 266*b*.

Figure 10A:
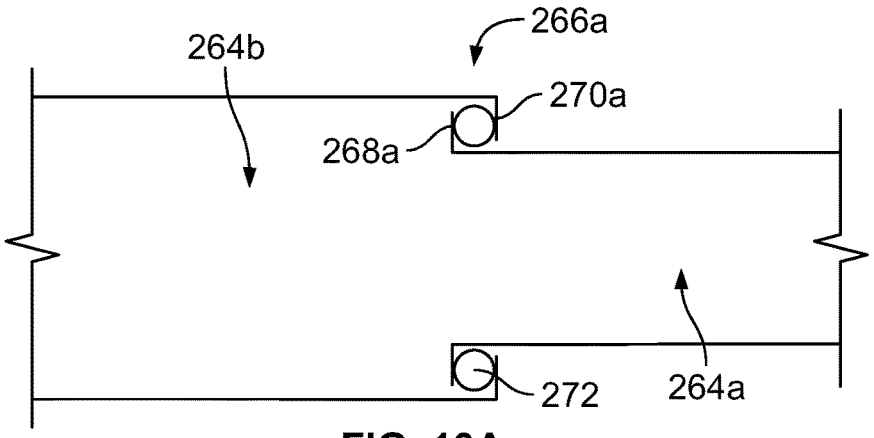
FIG. 10A is a close-up cross-sectional view of a joint between two sub-sections of the telescoping section of the pipe of FIG. 7 according to one embodiment of the present invention.

Turning to FIG. 10A, FIG. 10A illustrates one possible embodiment for joint 266*a* between various telescoping sub-sections. As can be seen from FIG. 10A, joint 266*a* is formed from an inner flange 268*a* on sub-section 264*a* and an outer flange 270*a* on sub-section 264*b*. So as to achieve a water-, or liquid-, tight seal between two adjacent telescoping sub-sections an O-ring 272 may be secured to the inner flange 268*a* of sub-section 264*a*. When the telescoping section 252 of pipe 218 is extended to its full length O-ring 272 is compressed between flanges 268*a* and 270*a* so as to achieve a water-, or liquid-, tight seal between adjacent telescoping sub-sections. In one embodiment, O-ring 272 can be formed from any suitable compressible material that can achieve a water-, or liquid-, tight seal. Such materials include, but are not limited to, a polymer material, a plastic material, or a synthetic or natural rubber material. In one embodiment, the material utilized to form O-ring 272 is synthetic rubber. Regarding the remaining joints between the other sub-sections of telescoping section 252, these joints may be substantially similar in design to the joint 266*a* discussed above.

Figure 10B:
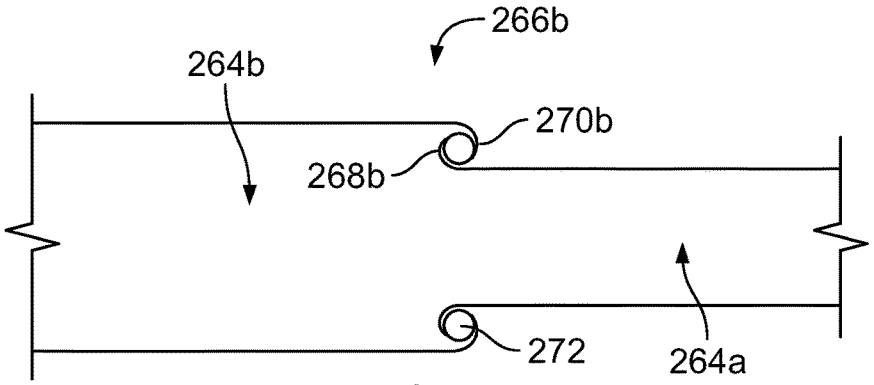
FIG. 10B is a close-up cross-sectional view of a joint between two sub-sections of the telescoping section of the pipe of FIG. 7 according to another embodiment of the present invention.
Figure 11:
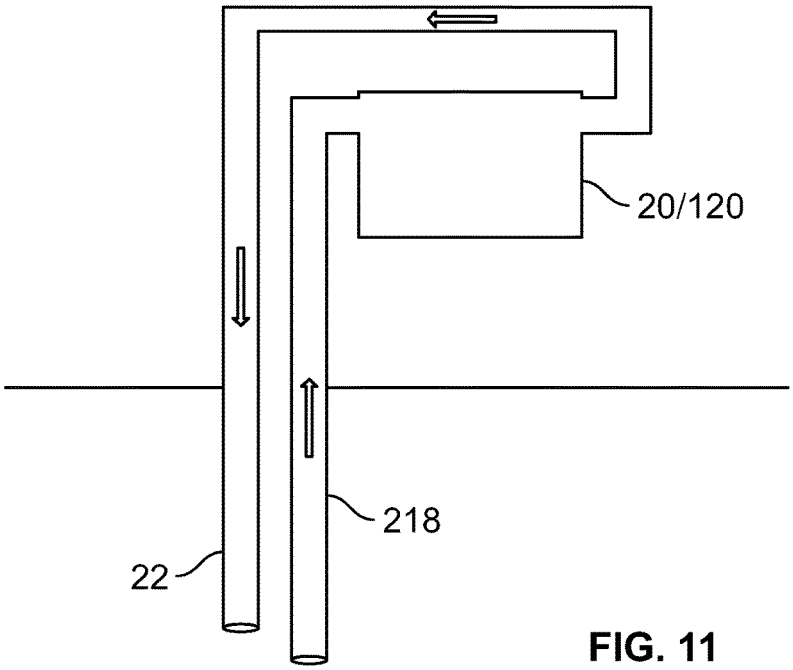
FIG. 11 is a schematic diagram of an embodiment of an assembly of the present disclosure.

In another embodiment, FIG. 10B illustrates another possible embodiment for joint 266*b* between various telescoping sub-sections. As can be seen from FIG. 10B, joint 266*b* is formed from an outwardly curved lip 268*b* on sub-section 264*a* and an inwardly curved lip 270*b* on sub-section 264*b*. So as to achieve a water-, or liquid-, tight seal between two adjacent telescoping sub-sections an O-ring 272 may be secured to the outwardly curved lip 268*b* of sub-section 264*a*. When the telescoping section 252 of pipe 218 is extended to its full length O-ring 272 is compressed between lip 268*b* and lip 270*b* so as to achieve a water-, or liquid-, tight seal between adjacent telescoping sub-sections. Again, O-ring 272 can be formed from any suitable compressible material that can achieve a water-, or liquid-, tight seal. Such materials include, but are not limited to, a polymer material, a plastic material, or a synthetic or natural rubber material. In one embodiment, the material utilized to form O-ring 272 is synthetic rubber. Regarding the remaining joints between the other sub-sections of telescoping section 252, these joints may be substantially similar in design to either of the joints 266*a* or 266*b* discussed above.

In order to achieve the extension of the various sub-sections of telescoping section 252 various methods can be utilized. Such methods include mechanical extension by the insertion of front portion 260 into an opening slightly smaller than the outer diameter of front portion 260. This permits a grabbing force to be exerted on the front end of telescoping section 252 whereby a pulling action from the opposite end of telescoping section 252 will achieve de-nesting of the various telescoping sub-sections of telescoping section 252. Alternatively, the pumping and/or vacuuming action of the system discussed above can be utilized to achieve the de-nesting (or extension) of telescoping section 252.

Regarding the various telescoping subsections 264*a*, 264*b* and 264*c*, these sub-sections (as well as any additional ones should more be desired) can be formed of any suitable metal or metallic alloy material that is cast, forged or poured into a cylindrical pipe shape. Suitable metals, or metallic alloys, include, but are not limited to, copper, iron, aluminum, titanium, steel, stainless steel, brass, bronze, etc. As would be apparent to those of skill in the art, each of the various sub-sections of telescoping section 252 can be formed from different metal, or metallic alloy, materials. Regarding the thickness of the metal, or metallic alloy, sub-sections of section 252, the thickness thereof is not critical so long as each telescoping sub-section of section 252 is strong enough to withstand the forces it is exposed through in use. In one non-limiting embodiment, the thickness of each sub-section of section 252 can be independently in the range of about 0.25 inches to about 1 inch in thickness, or from about 0.3 inches to about 0.8 inches in thickness, or from about 0.4 inches to about 0.7 inches in thickness, or even about 0.5 inches in thickness. Here, as well as elsewhere in the specification and claims, individual numerical values can be combined to form additional and/or non-disclosed ranges.

In another embodiment, the telescoping section 252 once extended can be returned to its nested orientation using a variety of methods. One such method relies on a cable and pulley system where the terminal end of the cable is mounted to a fixed cable anchor 274 on front portion 260 (see FIG. 9). A suitable cable (not shown) is fixedly attached to cable anchor 274 thereby permitting a user to use a winch, or some other mechanical device, to pull the front end of telescoping section 252 towards the back end of section 252 thereby resulting in the re-nesting of the various sub-sections of telescoping section 252.

While in accordance with the patent statutes the best mode and certain embodiments of the invention have been set forth, the scope of the invention is not limited thereto, but rather by the scope of the attached. As such, other variants within the spirit and scope of this invention are possible and will present themselves to those skilled in the art.

What is claimed is:

1. An apparatus for cleaning waste collection systems comprising:

at least one water pressurizer device outputting pressurized water against solid materials contained in a waste collection system, whereby the solid materials are suspended in a water slurry;

a tubular member;

at least one device controlling movement of the tubular member;

at least one pumping device pumping a slurry comprised of liquids and solids from the waste collection system through the tubular member, wherein the at least one pumping device is located downstream of the at least one water pressurizer device;

at least one vacuum device vacuuming a slurry comprised of liquids and solids from the waste collection system through the tubular member, wherein the at least one vacuuming device is located downstream of the at least one water pressurizer device;

at least one waste container; and at least one device decanting water from said waste container, wherein the tubular member comprises a flexible section having a first end and a second end and a telescoping section having a first end and a second end formed from at least two sub-sections, where the first end of the flexible section is joined to the waste container and the second end of the flexible section is joined to the first end of the telescoping section, and where the second end of the telescoping section is open so as to enable pumping or vacuuming of slurry into and through the tubular member to the waste container.

2. The apparatus of claim 1, wherein the telescoping section of the tubular member is formed from three or more sub-sections.

3. The apparatus of claim 1, wherein the telescoping section of the tubular member is formed from four or more sub-sections.

4. The apparatus of claim 1, wherein the sub-sections of the telescoping section of the tubular member decrease in cross-sectional diameter as they proceed away from the waste container end of the tubular member.

5. The apparatus of claim 1, wherein the sub-sections of the telescoping section of the tubular member increase in cross-sectional diameter as they proceed away from a location where the tubular member joins the waste container.

6. The apparatus of claim 1, wherein each sub-section of the telescoping section of the tubular member is individually formed of a metal or metallic alloy.

7. The apparatus of claim 6, wherein the metal or metallic alloy is selected from copper, iron, aluminum, titanium, steel, stainless steel, brass, or bronze.

8. The apparatus of claim 1, wherein the two or more sub-sections of the telescoping section of the tubular member are joined together by a water-, or liquid-, tight, joint formed from a combination of a flange at one end of each sub-section and a O-ring.

9. The apparatus of claim 1, wherein the flexible section of the tubular member is formed from a polymer material, a plastic material, or a synthetic or natural rubber material.

10. The apparatus of claim 1, wherein the apparatus is a mobile apparatus.

11. An apparatus for cleaning waste collection systems comprising:

at least one water pressurizer device outputting pressurized water against solid materials contained in a waste collection system, whereby the solid materials are suspended in a water slurry;

a tubular member;

at least one device controlling movement of the tubular member;

at least one pumping device pumping a slurry comprised of liquids and solids from the waste collection system through the tubular member, wherein the at least one pumping device is located downstream of the at least one water pressurizer device;

at least one vacuum device vacuuming a slurry comprised of liquids and solids from the waste collection system through the tubular member, wherein the at least one vacuuming device is located downstream of the at least one water pressurizer device;

at least one waste container; and wherein the tubular member comprises a flexible section having a first end and a second end and a telescoping section having a first end and a second end formed from at least two or more sub-sections, where the first end of the flexible section is joined to the waste container and the second end is joined to the first end of the telescoping section, wherein the two or more sub-sections of the telescoping section of the tubular member are joined together by a water-, or liquid-, tight, joint formed from a combination of a flange at one end of each sub-section and a O-ring, and where the second end of the telescoping section is open so as to enable pumping or vacuuming of slurry into and through the tubular member to the waste container.

12. The apparatus of claim 11, wherein the telescoping section of the tubular member is formed from three or more sub-sections.

13. The apparatus of claim 11, wherein the telescoping section of the tubular member is formed from four or more sub-sections.

14. The apparatus of claim 11, wherein the sub-sections of the telescoping section of the tubular member decrease in cross-sectional diameter as they proceed away from a location where the tubular member joins the waste container.

15. The apparatus of claim 11, wherein the sub-sections of the telescoping section of the tubular member increase in cross-sectional diameter as they proceed away from a location where the tubular member joins the waste container.

16. The apparatus of claim 11, wherein each sub-section of the telescoping section of the tubular member is individually formed of a metal or metallic alloy.

17. The apparatus of claim 16, wherein the metal or metallic alloy is selected from copper, iron, aluminum, titanium, steel, stainless steel, brass, or bronze.

18. The apparatus of claim 11, wherein the flexible section of the tubular member is formed from a polymer material, a plastic material, or a synthetic or natural rubber material.

19. The apparatus of claim 11, wherein the apparatus is a mobile apparatus.

20. The apparatus of claim 11, further comprising at least one decanting device-decanting water from said waste container.

21. An apparatus for cleaning waste collection systems comprising:

a water pressurizer outputting pressurized water against solid materials contained in a waste collection system;

a pumping device configured to pump a slurry from the waste collection system, wherein the pumping device is located downstream of the water pressurizer;

a vacuum device configured to vacuum a slurry from the waste collection system, wherein the vacuum device is located downstream of the water pressurizer;

a tubular member wherein the tubular member comprises a flexible section having first and second ends and a telescoping section having first and second ends formed from at least two sub-sections, wherein the first end of the flexible section is joined to the waste container and the second end of the flexible section is joined to the first end of the telescoping section, and wherein the pumping device pumps or the vacuum device vacuums slurry into and through the tubular member to the waste container.

22. The apparatus of claim 21 further comprising a boom controlling movement of the tubular member.

* * * * *